United States Patent [19]

Tacker

[11] Patent Number: 4,878,710

[45] Date of Patent: Nov. 7, 1989

[54] WALL PROXIMITY CHAIR

[75] Inventor: Billy D. Tacker, Okolona, Miss.

[73] Assignee: Super Sagless Corporation, Tupelo, Miss.

[21] Appl. No.: 217,155

[22] Filed: Jul. 11, 1988

[51] Int. Cl.[4] ..... A47C 1/02

[52] U.S. Cl. ..... 297/68; 297/85

[58] Field of Search ..... 297/68, 88, 84, 89, 297/322

[56] References Cited

U.S. PATENT DOCUMENTS

| | | | |
|---|---|---|---|
| 4,185,869 | 1/1980 | Rogers, Jr. | 297/84 |
| 4,249,772 | 2/1981 | Rogers, Jr. | 297/68 |
| 4,350,387 | 9/1982 | Rogers, Jr. | 297/85 |
| 4,352,523 | 10/1982 | Holobaugh | 297/68 |
| 4,591,205 | 5/1986 | James | 297/85 |
| 4,740,031 | 4/1988 | Rogers, Jr. | 297/85 |

*Primary Examiner*—Francis K. Zugel

*Attorney, Agent, or Firm*—Wolf, Greenfield & Sacks

[57] ABSTRACT

A three-position reclining chair capable of being placed with its backrest immediately adjacent to a wall without interference from the wall when the chair is reclined. The chair has a base, a rigidly connected seat and armrest assembly, a backrest movably on the seat and armrest assembly, a footrest, and linkage mechanisms for connecting the several parts of the chair together and allowing the chair to assume any of the three positions. The mechanism includes compound front and area pivot linkages which carry a support link on a base plate, and the support link forms part of and carries a four-bar linkage which includes a seat mounting bracket. The compound linkages enable the support link and seat and armrest assembly to move forward when the chair is reclined to provide room for the backrest to tilt back without interference from the wall.

12 Claims, 7 Drawing Sheets

WALL PROXIMITY CHAIR

This invention relates to reclininq chairs and more particularly relates to three-position recliners which may be placed in close proximity to a wall or other furniture without interference when the chair is reclined.

Reclining chairs have enjoyed great popularity for many years. Literally millions of reclining chairs have been sold.

The early reclining chairs required that they be placed several feet from the wall or other furniture to enable the backrest to recline fully without interference. Many of the early reclininq chairs had fixed arms, and to move the chairs to a reclining position, the occupant would push against the arms so as to force his or her body against the backrest. In that type of chair, the reclininq action was achieved by tilting the seat and backrest rearwardly and downwardly with respect to the fixed arms, which moved the backrest rearwardly. That motion created the requirement for substantial clearance between the wall or other furniture and backrest when the chair was upright.

In the late 1960s and 1970s, particularly as housing units became smaller, chair manufacturers sought ways to modify the construction so as to enable a reclining chair to be placed closer to the wall without causing the wall to interfere with the tilting motion of the backrest as it moved from the upright position to a reclining position. Examples of those chairs are shown in U.S. Pat. Nos. 3,874,724; 4,077,663; 4,099,776; 4,153,292; 4,195,878 and 4,202,580. Many of those so-called wall proximity chairs have long tracks, on which substantially the entire chair including the base and frame move forwardly as the back tilts rearwardly toward the wall in response to pressure against the arms to compensate for the rearward tilting of the backrest. Some of those arrangements included channel shaped tracks twelve inches or more in length. Roller links are carried on rollers which roll back and forth in the tracks, and the roller links in turn support front and rear pivot links that carry the seat mounting link. The long travel path of the chair frame on the tracks particularly during the reclininq action may create a feeling of instability for the occupant, which many people find unacceptable. The tracks and rollers also add significantly to the manufacturing costs of the mechanisms.

In seeking to improve the styling of reclining chairs, manufacturers sought ways, for example, to enable T-cushions to be used. This was not possible in chairs in which the seat moved rearwardly with respect to the side arms, because the winds of the T-cushion would engage the front of the arms and the cushion could not travel rearwardly with the seat frame. Consequently, designers sought ways to reverse the direction of motion of the seat with respect to the frame or alternatively to fix the arms with the seat so that they maintained the same relative positions with respect to one another both in the upright and reclining positions of the chair. Because the arms and seat move together in those chairs, means other than pressing against the chair arms had to be found to actuate the chairs. The wide use of handle operated actuating mechanisms in reclininq chairs was the result.

More recent developments in the reclininq chair art enable the chairs to be placed closer to the wall. Chair mechanisms including combinations of linkages and tracks have reduced the wall clearance required, but the industry continues to look for suitable mechanisms which allow reclininq chairs to be placed even closer to the wall.

How close to a wall a reclining chair may be placed is by no means the sole criteria of a mechanism's acceptability. The mechanism must, of course, provide a very comfortable relationship between the seat, arms and backrest. It must also require very little effort to operate. The action of the mechanism must be smooth so as not to impart a feeling of instability to the chair user as it moves between the upright and reclininq positions. Furthermore, the nature of the industry requires that the manufacturing costs be competitive.

The development and manufacture of mechanisms has grown into a separate division within the furniture industry, and at the present time, many manufacturers employ large technical staffs and expend very substantial amounts of time and money in search for improved mechanisms.

The principal object of the present invention is provide a linkage mechanism for reclininq chairs, which enables a chair in which the mechanism is incorporated to be placed immediately adjacent the wall, that is, within less than one inch of the wall without incurring any interference from the wall as the chair moves from the upright to the reclining position.

Another object of the present invention is provide a linkage mechanism for reclininq chairs which is free of rollers and tracks and which therefore is less expensive to manufacture than other mechanisms that enable a chair to be placed immediately adjacent to the wall.

To accomplish these and other objects the reclininq chair of the present invention includes a fixed arm and seat assembly mounted on and movable with respect to a base, a backrest movable with respect to the arm and seat assembly, a footrest, and a pair of linkage mechanisms, one on each side of the frame, connecting the arm and seat assembly, backrest, footrest, and base together and enabling the chair to move from upright to TV and fully reclined positions, and to return to the upright position. Each mechanism includes a base plate which carries front and rear compound pivot linkages which in turn carry a support link. The support link in turn carries a pair of swings links that bear the seat mounting link. The support link is capable of movinq fore and aft with respect to the base plate, and the seat mounting link is mounted to move fore and aft with respect to the support link. These two motions carry the seat and arm assembly of the chair sufficiently forward so as to enable the backrest of the chair to move rearwardly in the direction of the wall against which the chair is placed, without interference. The front pivot linkage includes a pair of swing links suspended at their upper ends on a plate fixed to the base plate, and the swing links in turn carry an upwardly extending pivot link from their lower ends. The upper end of the pivot link is connected to the support link. The rear pivot linkage includes a pair of links connected end to end with the opposite end of one pivotally mounted on the base plate and the opposite end of the other connected to the support link. A control link joins the two pivot linkages so as to cause them to act in unison and prevent them from collapsing.

A handle actuating mechanism is provided to enable the chair occupant to conveniently extend the footrest and at the same time place the occupant's weight in a position to automatically drive the mechanism to the TV position. Pressure against the backrest of the chair when in the TV position causes the seat mounting link to advance with respect to the support link to achieve the fully reclined position.

These and other objects and features of the present invention will be better understood and appreciated from the following detailed description of one embodiment thereof, selected for purposes of illustration and shown in the accompanying drawings.

FIGURE DESCRIPTION

FIG. 1 a right side elevation view, somewhat diagrammatic, of a reclininq chair constructed in accordance with the present invention and in its upright position;

DETAILED DESCRIPTION

Figure 1:
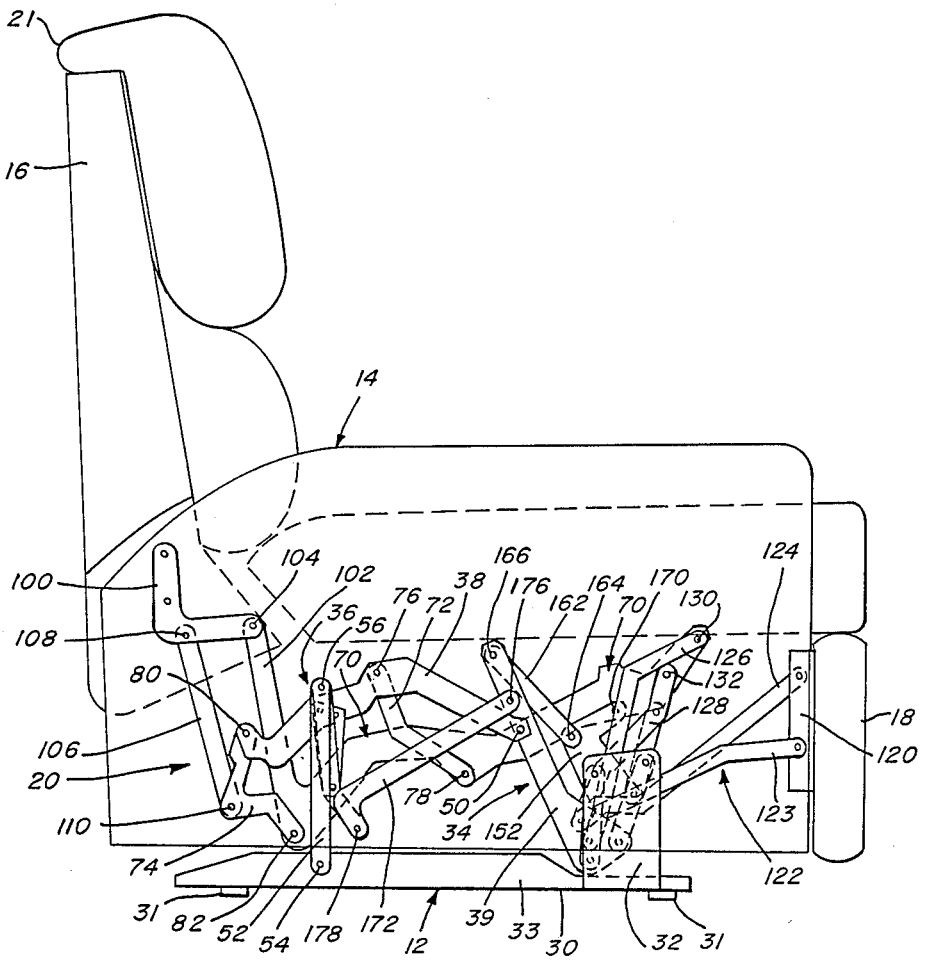

The present invention is shown in the drawings embodied in a reclining chair having a base 12, a seat and arm panel assembly 14, a backrest 16 and a footrest 18. The seat and arm panel assembly 14, backrest 16 and footrest 18 are mounted on the base 12 and secured to one another by a pair of linkage mechanisms 20 one on each side of the chair. The two mechanisms are mirror images of one another and only one is described below. The mechanisms 20 enable the chair to move between the upright position shown in FIG. 1, the TV or intermediate reclining position shown in FIG. 2 and the fully reclined position of FIG. 3. In the upright position, the chair may be placed with the upper rear edge 21 of the backrest less than one inch from the wall, and the chair is able to move to the TV and fully reclined positions without interference from the wall.

Each linkage mechanism 20 includes a base plate 30 forming part of the base 12 and extending front to back under the seat. The base plate 30 ordinarily is mounted on the cross-braces (not shown) of the chair frame, or they may be connected to one another and rest on the floor so as to function as the support for the chair. The base plate 30 is made from a steel angle member and is shown to have feet 31 which protect the floor. A generally rectangular front plate 32 is welded or otherwise secured to the vertical flange 33 of the base plate 30 and extends vertically upwardly therefrom as is clearly shown in FIGS. 1–3.

Figure 6:
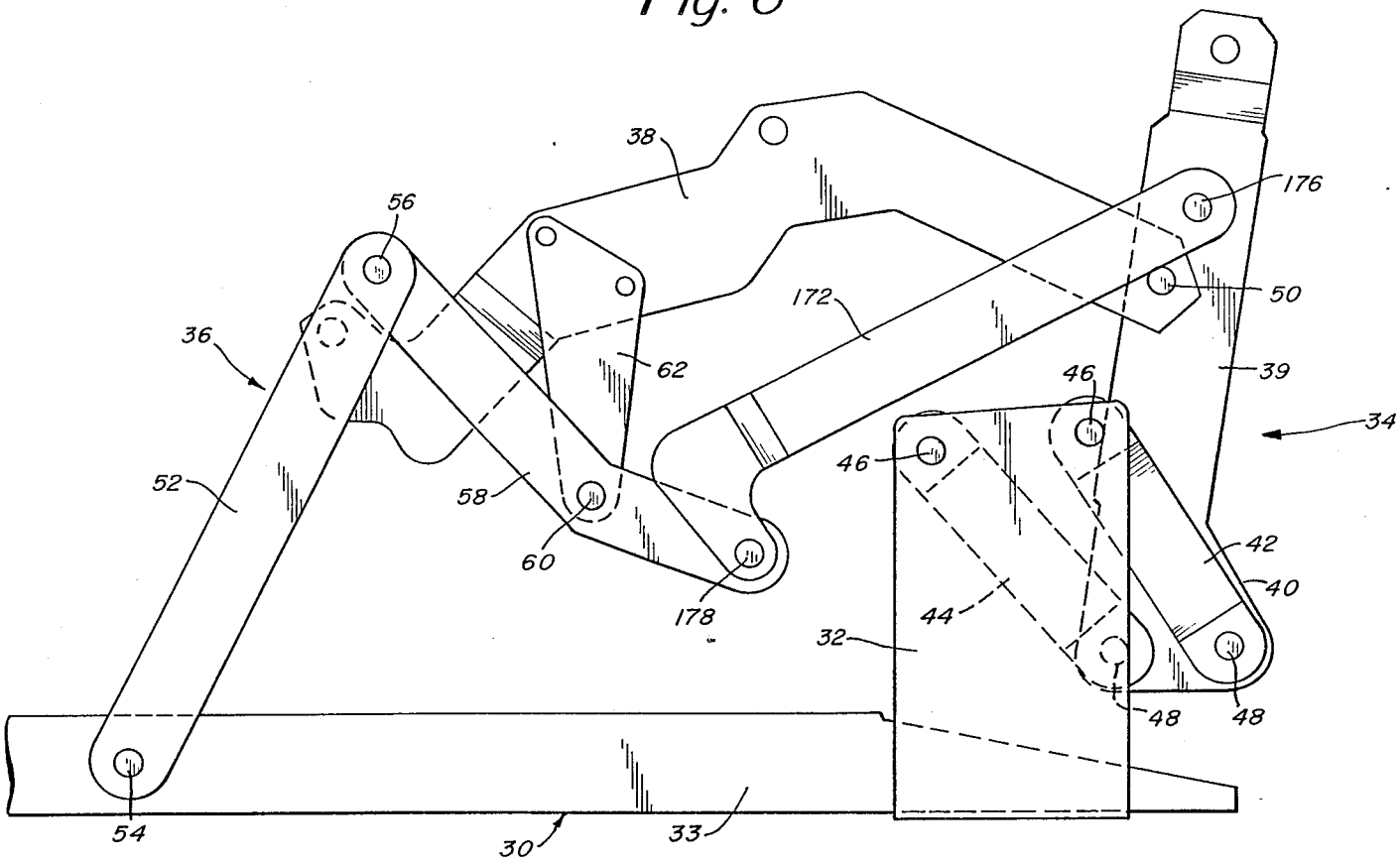
FIG. 6 is a fragmentary right side elevation view of the linkage mechanism and showing the compound front and rear pivot linkages, link and control link in the reclined position.

Front and rear compound pivot linkages 34 and 36 each composed of a series of links, together carry a support link 38 above the base plate 30. The front pivot linkage 34 (see FIGS. 2, 3 and 6) consists of a pivot link 39 and a pair of front swing links 42 and 44. The swing links 42 and 44 are connected at their upper ends by pivot rivets 46 to the upper end of front plate 32, and the lower ends of the swing links are connected by pivot rivets 48 to the enlarged lower end 40 of the pivot link 39. Pivot rivet 50 joins the pivot link 39 intermediate its ends to the forward end of the support link 38.

The rear pivot linkage 36 (see FIGS. 2, 3 and 6) includes a pivot link 52 and a swing link 58. The pivot link 52 is pivotally secured at its lower end by pivot rivet 54 to the base plate 30. The upper end of pivot link 52 is secured by pivot rivet 56 to the swing link 58. The swing link 58 in turn is connected intermediate its ends by pivot rivet 60 to the bottom of bracket 62 which is riveted to the support link 38. Bracket 62 thus essentially is part of the support link 38.

Figure 7:
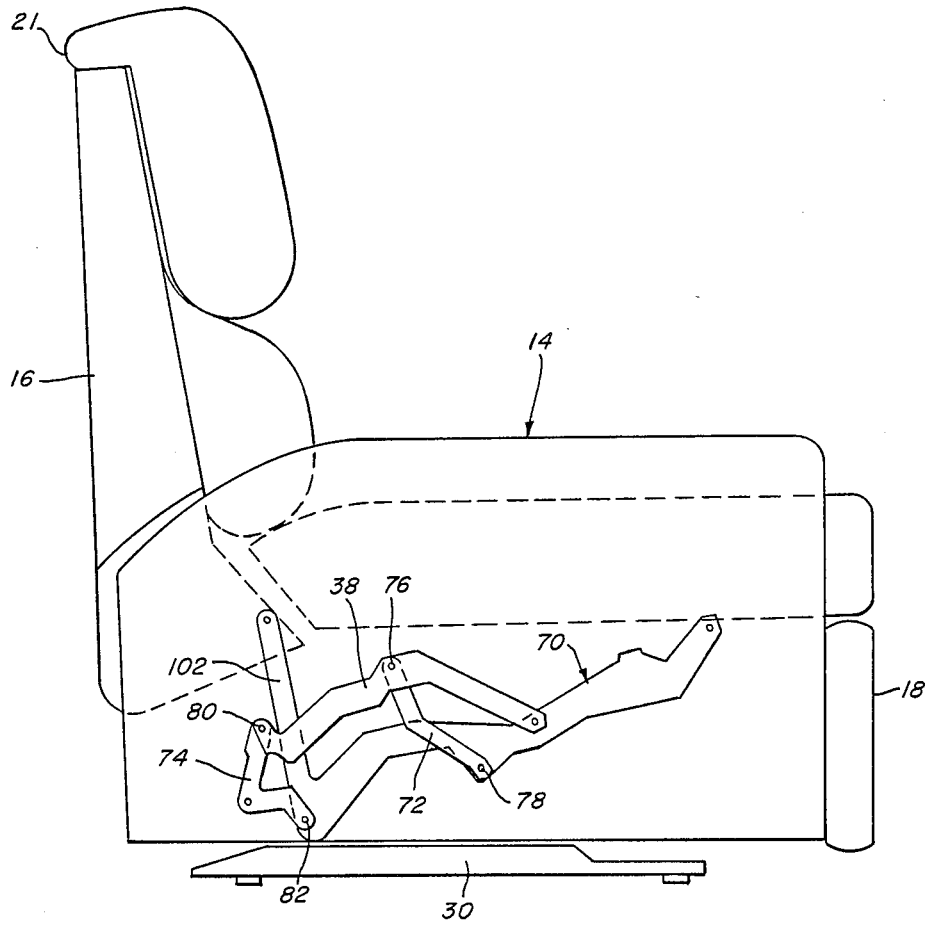
FIG. 7 is a right side elevation view of the chair in the upright position and particularly showing the four-bar linkage composed of the support link, seat mounting bracket and front and rear swing links.

The support link 38 carries a seat mounting link 70 on a pair of swing links 72 and 74 which are sometimes termed "seat support link" and "seat drive link", respectively. (See FIGS. 2, 3 and 7.) The seat support link 72 is secured at its upper end by pivot rivet 76 to support link 38 and at its lower end by rivet 78 to the seat mounting link 70 The seat drive link 74 is secured at its upper end by pivot rivet 80 to support link 38 and at its lower end by pivot rivet 82 to the seat mounting link. The seat mounting link 70, support link 38, seat support link 74 and seat drive link 72 together form a four-bar linkage which enables the seat mounting link 70 to swing fore and aft with respect to the support link 38 as is more specifically described below. The seat mounting link 70 is secured directly to the seat and arm panel assembly 14 and carries that assembly with it as the seat mounting link moves from one to another of its three positions as the mechanism is operated.

The backrest 16 is carried by a backrest bracket 100 pivotally supported by pivot rivet 104 on the upper extension 102 of the seat mounting bracket 70. The bracket 100 as is evident in the drawings, supports the backrest 16 for pivotal motion with respect to the seat and arm panel assembly 14. The bracket 100 is controlled by back support link 106 attached by pivot rivet 108 at is upper end to bracket 100. The lower end of back support link 106 is secured by pivot rivet 110 to the seat support link 74. When the seat mounting bracket 70 moves with respect to support link 38 as a result of the swinging motion of the seat support link 74 and seat drive link 72, the backrest bracket 100 pivots counterclockwise about its pivot rivet 104 as viewed in FIGS. 1–3, causing the backrest 16 to swing rearwardly with respect to the seat and arm panel assembly 14. As is described more fully below, pressure exerted against the backrest 16 causing it to pivot rearwardly, in turn causes the back support link 106 to pivot the seat support link 74 about pivot 80 so as to move the seat mounting bracket 70 in a forward direction with respect to support link 38.

Figure 2:
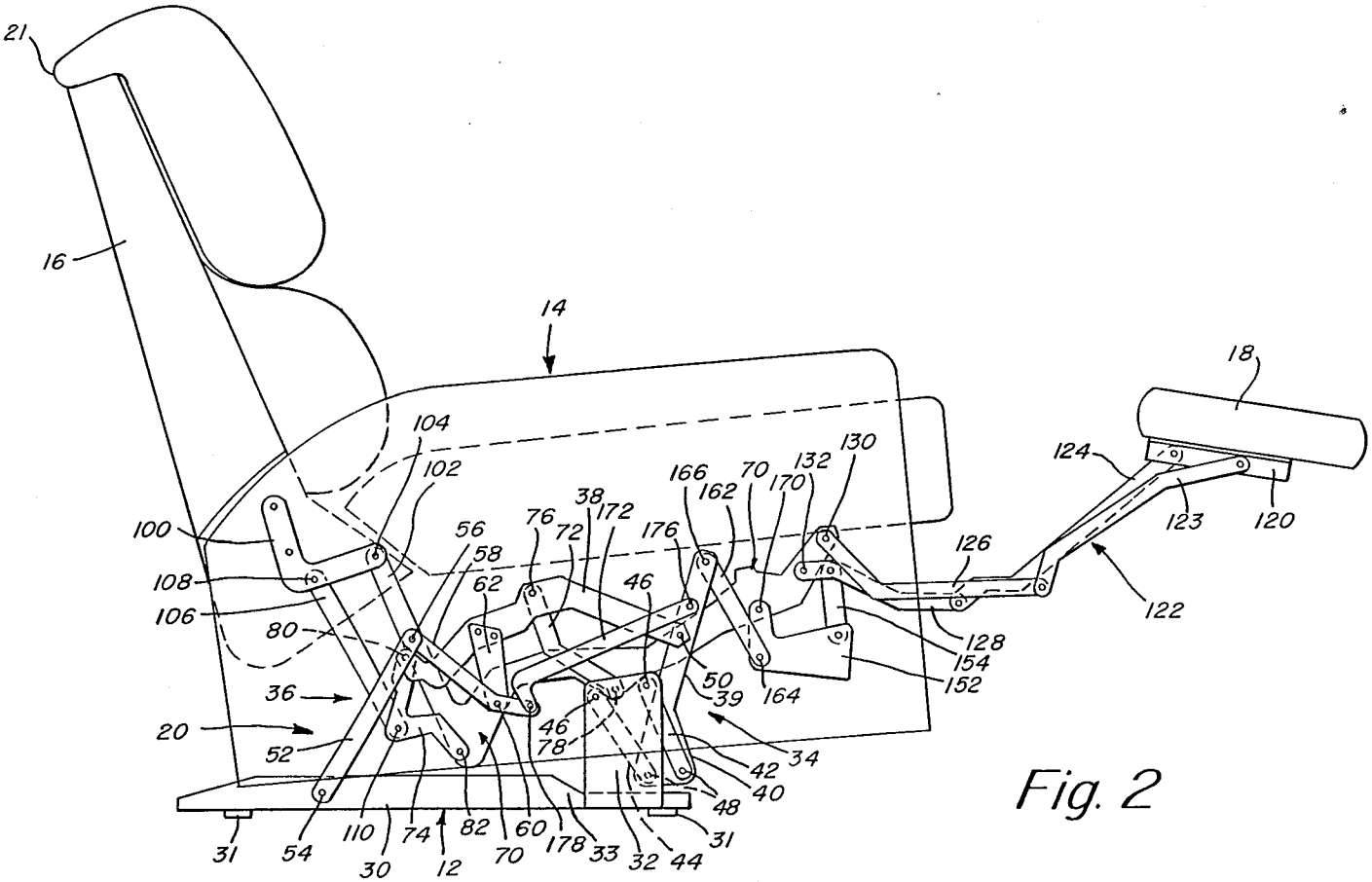
FIGS. 2 and 3 are right side elevation views similar to FIG. 1 but showing the chair in the TV and fully reclined positions, respectively.
Figure 3:
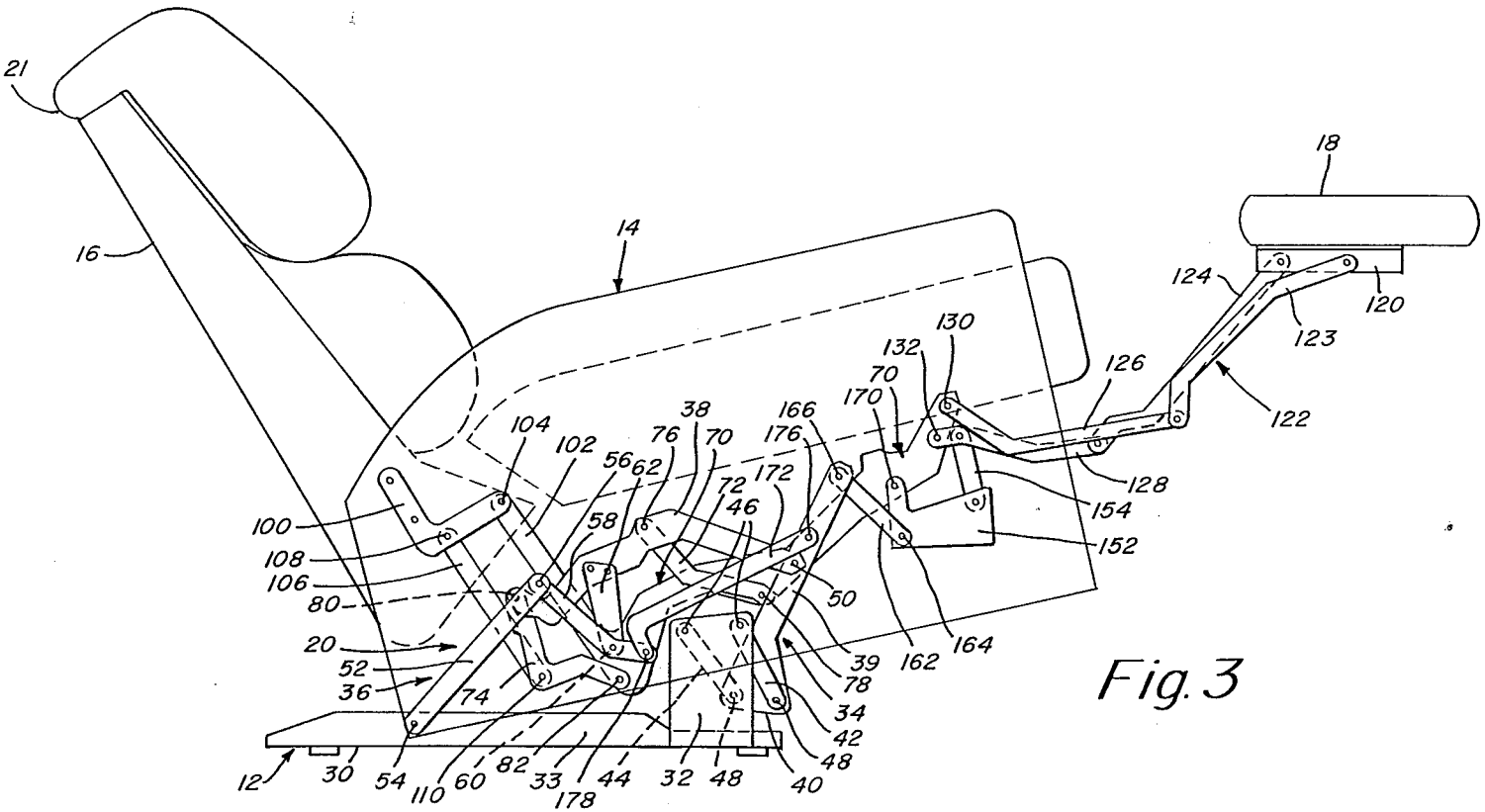

The footrest 18 is best shown in FIGS. 2 and 3 to be mounted on a footrest bracket 120 that in turn is carried by a lazy tong linkage 122 mounted on the forward end of the seat mounting bracket 70. The lazy tong linkage includes a first pair of links 123 and 124 each connected at one end to footrest bracket 120 and at their other ends to a second pair of links 126 and 128. Rivets 130 and 132, respectively, connect the opposite ends of links 126 and 128 to the seat mounting bracket 70. The lazy tong linkage composed of the links 123, 124, 126 and 128 functions in the conventional manner so as to extend the footrest 18 to the positions of FIGS. 2 and 3 when the linkage is opened and to retract the footrest 18 to its vertical position below the seat when the linkage is closed.

Figure 4:
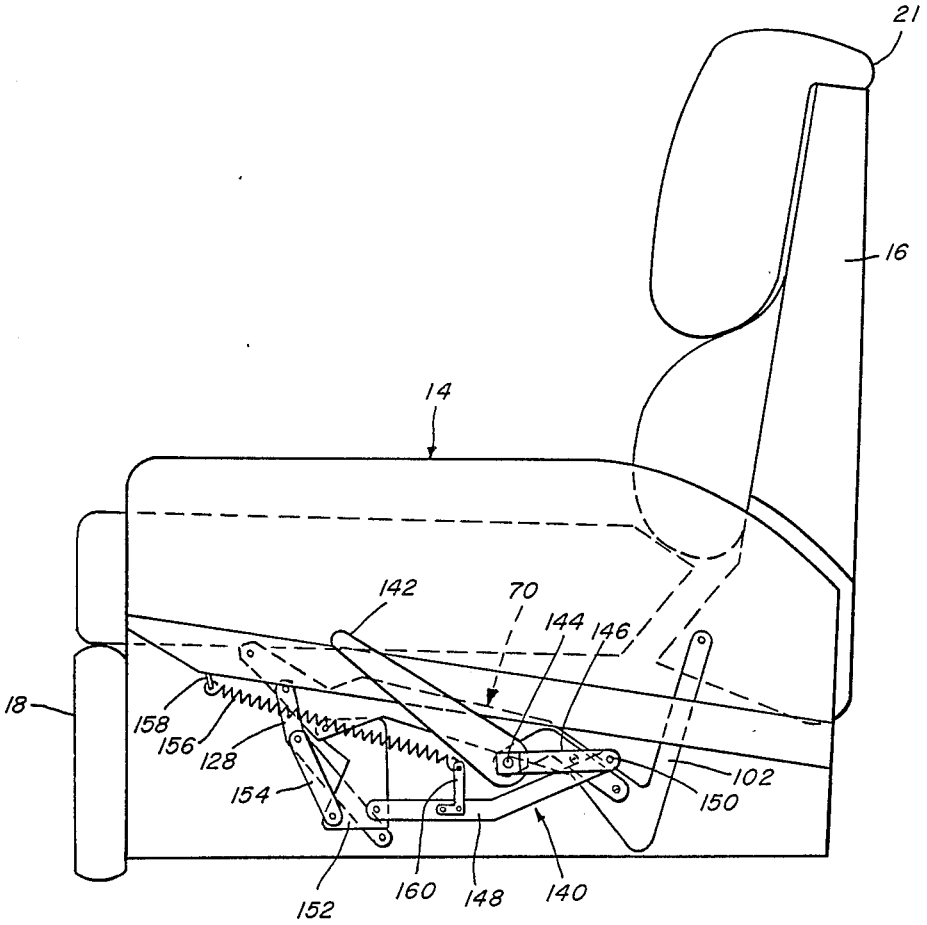
FIG. 4 is a fragmentary left side elevation view of the chair of FIG. 1 in the upright position and showing the handle operated mechanism.
Figure 5:
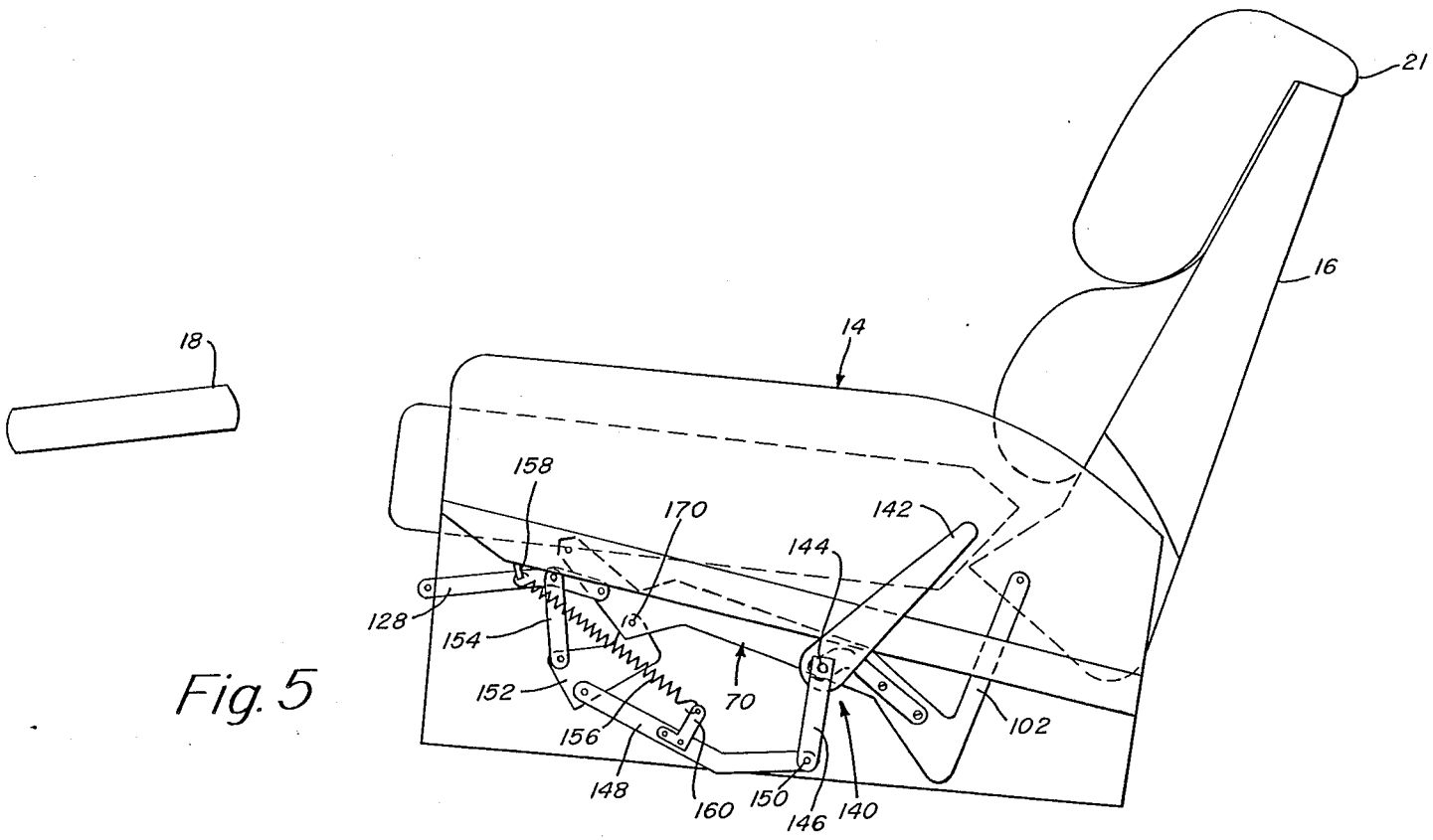
FIG. 5 is a left side elevation view similar to FIG. 4 but showing the actuating mechanism in the reclining position.

The lazy tong linkage 122 is actuated by a handle assembly 140 shown in FIGS. 4 and 5. The handle assembly includes a handle 142 pivotally mounted on the seat mounting bracket 70 by pivot pin 144. The handle 142 is keyed to and pivots a first actuating link 146 which in turn is connected to a second actuating link 148 by rivet pivot 150. The second actuating link 148 is connected at its forward end to drive transfer link 152 which in turn is connected by a sequencing link 154 to the lazy tong linkage 122. When the second actuating link 148 moves to the left (forwardly) from the position shown in FIG. 4 to that of FIG. 5, it pivots the drive transfer link 152 in a clockwise direction which in turn elevates the sequencing link 154 so as to cause the lazy tong linkage 122 to open and elevate footrest 18 (see also FIGS. 2 and 3). This action is assisted by a coil spring 156 extending under tension between an eye 158 on the side panel assembly 14 and a bracket 160 fixed to the second actuating link 148. Spring 156 urges the actuating link 148 to the left, and this in turn causes the action of the drive transfer link 152 and sequencing link 154 described above. As a result, very little force need be applied to handle 142 to actuate the mechanism. When the handle pivots clockwise as viewed in FIG. 4 and causes the pivot 150 to pass over the axis of spring 156, the spring 156 immediately takes over and provides the force required to elevate the footrest.

A footrest drive link 162 (see FIGS. 1–3) is also pivoted at one end to the drive transfer link 152 by pivot rivet 164, and its other end is pivoted by means of rivet 166 to the upper end of pivot link 39. The footrest drive link 162, as is explained more fully below in connection with the operation of the chair, serves to draw the pivot link 39 to the right as viewed in the FIGS. 1–3 as the drive transfer link 152 pivots about its pivotal support on the seat support link 70 under the influence of the handle actuating assembly 140.

A control link 172 is shown in FIGS. 1–3 and 6 to be connected at its forward end to pivot link 39 by rivet pivot 176. That connection is disposed slightly above the rivet pivot 50 which joins the pivot link 39 to the front end of support link 38. The rear end of control link 172 is connected by rivet pivot 178 to the lower forward end of rear swing link 58 forming part of the rear pivot linkage 36. Control link 172 causes the front and rear pivot linkages 34 and 36 to operate in tandem and prevents the mechanism from collapsing.

As stated above, the chair of the present invention is intended to move from the upright position of FIG. 1 to the TV position of FIG. 2 and the fully reclined position of FIG. 3. The change is effected by the chair occupant in the first instance when the chair is in the upright position by actuating the handle assembly 140. To move from the TV position of FIG. 2 to the fully reclined position of FIG. 3, the occupant applies a backwardly directed force against the backrest 16, which causes the back to move relative to the seat and armrest. As is evident from an inspection of FIGS. 1–3, as the chair moves from the upright to the TV position, the seat and armrest assembly 14 and the backrest 16 move forwardly with respect to the base plate 30, and when the chair moves from the TV to the fully reclined position, the seat and arm assembly 14 moves further forward with respect to the base plate 30 while the backrest pivots counterclockwise as viewed in FIGS. 2–3. The travel of the seat and arm assembly 14 with respect to the base provides the room necessary for the backrest to tilt counterclockwise without engaging the wall or any other furniture which may be disposed closely adjacent the back of the chair. To return the chair from the fully reclined to the upright position, the occupant relieves the pressure against the backrest 16 and applies downward pressure on the footrest 18, which first causes the backrest 16 to pivot clockwise with respect to the seat and arm assembly 14 and then allows the entire seat and armrest assembly along with the backrest to move rearwardly on the base plate 30 as the lazy tong 122 collapses, so as to return the footrest 18 to the position below the front of the seat cushion.

A detailed description of the operation follows. An occupant of the chair sitting upright with the chair in the position of FIG. 1 and wishing to recline the chair to the TV position of FIG. 2 or the fully reclined position of FIG. 3 merely pulls the top of handle 142 rearwardly from the position of FIG. 4 to the position of FIG. 5. This action causes the first and second actuator links 146 and 148, respectively to pivot clockwise about the pivot 144 and move toward the front of the chair (to the left as viewed in FIGS. 4 and 5 drawings) so as to pivot the transfer link 152 from the position of FIG. 4 to the position of FIGS. 2 and 5. As the rivet pivot 150 passes across the axis of spring 156, the actuation is assisted by the spring, which serves to draw the second actuator link 148 in the forward direction.

Rotation of the drive transfer link 152 about its pivotal mounting 170 on the seat mounting link 70 does two things. First, it draws the footrest drive link 162 downwardly from the position of FIG. 8 to the position of FIG. 2 which in turn causes the front and rear pivot linkages 34 and 36 to move over center, and as a result the downwardly directed force imposed by the weight of the occupant of the chair causes the support link 38 to move forwardly and downwardly with respect to the base plate 30 which supports it. It also causes the weight of the occupant to push the footrest drive link 162 further downwardly and assist in rotating the transfer link 152 about its pivotal support 170. Second, the pivotal shifting of the drive transfer link 152 acts upon the sequence link 154 to pivot the lazy tong linkage 122 on the seat mounting link 70 and thereby extend the footrest 18 to the elevated position of FIG. 2. The combination of rear pivot link 52 and rear swing link 58 that together comprise the rear pivot linkage 36, and the front swing links 42 and 44 with the front pivot link 39 that together comprise the front pivot linkage 34, provide substantially greater travel for the support link 38 than could be derived from single front and rear pivot links mounted directly on the base plate 30 and carrying the support link. The greater travel of the support link 38 afforded by the arrangement of the present invention in turn carries the seat mounting link 70 further forward than would otherwise be possible. The control link 172 connected between the rear swing link 58 and the front pivot link 39 causes the front and rear compound pivot linkages to move in unison and prevent collapse of the mechanism.

During the operation thus far described, the seat mounting link 70 remains essentially fixed with respect to the support link 38. The forward swing of the front and rear pivot linkages causes the seat and armrest assembly 14 to move forwardly and to tilt slightly as is evident in a comparison of FIGS. 1 and 2 so as to place the chair in a partially reclined or TV position. The top rear edge 21 of the backrest 16 pivots rearwardly, but the edge does not strike the wall immediately behind it because of the substantial forward travel of the seat and backrest assembly. If the occupant wishes to move from the TV position to the fully reclined position of FIG. 3, he or she need only push against the backrest 16. This action causes the backrest bracket 100 to pivot on its pivot rivet 104 in a counterclockwise direction from the position shown in FIG. 2 to the position of FIG. 3, and also causes the backrest support link 106 to pivot the seat support link 74 in a counterclockwise direction about its pivot 80 so as to move the seat mounting bracket 70 in a forward direction. This, in turn, causes the seat and armrest assembly 14 mounted on bracket 70 to move further forward on the base plate 30 to the position of FIG. 3. During this action, the footrest 18 remains essentially fixed with respect to the seat. The additional motion of the seat and armrest assembly 14 away from the wall provides more than enough room for the backrest 16 to pivot rearwardly with respect to the seat and armrest assembly without interference from the wall adjacent which the chair is placed To return the fully reclined chair to the upright or TV position of FIGS. 1 and 2, respectively, the occupant need only relieve the pressure against the backrest 16. This will cause the seat mounting bracket 70 to swing rearwardly on the seat support link 72 and seat drive link 74 suspended from the support link 38, and the assembly will return to the position of FIG. 2. To proceed to the fully upright position, the occupant applies a downward pressure with his or her legs on the footrest 18, which will close the lazy tong linkage 122 and pivot the drive transfer link 152 on the seat mounting link, which in turn causes the front pivot link 39 to pivot counterclockwise and also causes the swing links 42 and 44 to swing back on the vertical plate 32, and a corresponding action is imparted to the rear pivot linkage 36 through the control link 172. In this fashion, the chair moves to the fully upright position.

From the foregoing description, it will be appreciated that a chair constructed in accordance with the present invention having a normal backrest height of approximately 36 inches and placed less than one inch of a wall when in the upright position may be moved to the TV and fully reclining positions without interference from that wall. The compound linkages which make up the front and rear pivot linkages provide very substantial travel for the support link 38 to make room for the reclininq action of the backrest. In addition, the effective length of each of the links 72 and 74 which carry the seat mounting bracket 70 is large so as to provide greater swing of the seat mounting bracket with respect to the support link 38.

The mechanism of the present invention is free of rollers and tracks and therefore is relatively inexpensive to manufacture while providing the chair with the ability to be placed immediately adjacent to the wall. The elimination of the rollers and tracks found in many of the prior art devices reduce the manufacturing cost of the mechanism by approximately 0%.

Having described this invention in detail, those skilled in the art will appreciate that numerous modifications may be made of the invention without departing from its spirit. Therefore, it is not intended that the scope of this invention be limited to the single embodiment illustrated and described. Rather, the scope of the invention is to be determined by the appended claims and their equivalents.

I claim:

1. A reclining chair having a base, seat and backrest, and a pair of linkage mechanisms for supporting the seat and backrest for movement between upright, TV and reclining positions, each of said linkage mechanisms comprising a base plate forming part of the base, a support link, front and rear pivot linkages pivotally carrying the support link above the base plate, said rear pivot linkage including a pivot link and an additional link connected in series between the base plate and support link, said front pivot linkage including a pair of substantially parallel swing links pivoted at their upper ends to the base plate and a front pivot link connected at its lower end to the lower ends of the pair of swing links, said front pivot link being connected intermediate its ends to the support link.

a control link connected between the front and rear pivot linkages for preventing collapse of the support link and pivot linkages on the base plate, a seat mounting bracket carried on the support link by a second pair of swing links, said seat mounting bracket carrying the seat, and an actuating linkage including a handle mounted on the seat mounting bracket for causing the front and rear pivot linkages to swing the support link forwardly and the seat mounting bracket and seat to the TV position.

2. A chair as defined in claim 1 wherein the pivot link of the rear pivot linkage is pivotally connected adjacent its lower end to the base plate and is pivotally connected adjacent its other end to the additional link, said additional link being pivotally connected to the support link below the connection to the pivot link.

3. A chair as defined in claim 1 wherein a footrest and lazy tong linkage carrying the footrest are mounted on the seat mounting bracket, and movable between extended and retracted positions, and the actuating linkage is connected to the lazy tong linkage for extending the footrest when the support link moves forwardly with respect to the base plate and the seat moves from the upright to the TV position.

4. A chair as defined in claim 1 wherein a backrest bracket is mounted on the seat mounting link and carries the backrest, and a back support link is connected between the backrest bracket and second pair of swing links for causing pressure exerted against the backrest to cause the backrest to push rearwardly with respect to the seat and the seat to move forwardly and upwardly with respect to the base plate.

5. A chair as defined in claim 2 wherein a footrest and lazy tong linkage carrying the footrest are mounted on the seat mounting bracket, and movable between extended and retracted positions, and the actuating linkage is connected to the lazy tong linkage for extending the footrest when the support link moves forwardly with respect to the base plate and the seat moves from the upright to the TV position.

6. A chair as defined in claim 5 wherein a backrest bracket is mounted on the seat mounting link and caries the backrest, and a back support link is connected between the backrest bracket and second pair of swing links for causing pressure exerted against the backrest to cause the backrest to push rearwardly with respect to the seat and the seat to move forwardly and upwardly with respect to the base plate.

7. A chair as defined in claim 1 wherein the control link is connected to the pivot link of the front pivot linkage and to the additional link of the rear pivot linkage.

8. A reclining chair having a base, seat and backrest, and a pair of linkage mechanisms for supporting the seat and backrest for movement between upright and a reclining position, each of said linkage mechanisms comprising a base plate forming part of the base, a support link, front and rear pivot linkages pivotally carrying the support link above the base plate, said front pivot linkage including a pair of substantially parallel swing links pivoted at their upper ends to the base plate and a front pivot link connected at its lower end to the lower ends of the pair of swing links, said front pivot link also being connected to the support link, a control link connected between the front and rear pivot linkages for preventing collapse of the support link and pivot linkages on the base plate, a seat mounting bracket carried by the support link, said bracket carrying the seat, and a handle operated linkage operatively connected to the front and rear pivot linkages of the mechanisms for enabling an occupant of the chair to cause the support link and seat mounting bracket and seat to move to the reclined position.

9. A chair as defined in claim 8 wherein a footrest and lazy tong linkage carrying the footrest are mounted on the seat mounting bracket, and movable between extended and retracted positions, and the actuating linkage is connected to the lazy tong linkage for extending the footrest when the support link moves forwardly with respect to the base plate and the seat moves from the upright to the reclined position.

10. A chair as defined in claim 8 wherein a backrest bracket is mounted on the seat mounting link and carries the backrest, and a back support link is connected between the backrest bracket and one of the second pair of swing links for causing pressure exerted against the backrest to cause the backrest to push rearwardly with respect to the seat and the seat to move forwardly and upwardly with respect to the base plate.

11. A chair as defined in claim 10 wherein a backrest bracket is mounted on the seat mounting link and carries the backrest, and a back support link is connected between the backrest bracket and one of the second pair of swing links for causing pressure exerted against the backrest to cause the backrest to push rearwardly with respect to the seat and the seat to move forwardly and upwardly with respect to the base plate.

12. In a reclining chair having a base, seat and backrest, a pair of linkage mechanisms for supporting the seat and backrest for movement between upright and reclined positions, each of said mechanism including a base plate forming part of the base, a support link, front and rear pivot linkages pivotally carrying the support link above the base plate, said front pivot linkage including a pair of substantially parallel swing links pivoted at their upper ends to the base plate and a front pivot link connected at its lower end to the lower ends of the pair of swing links, said front pivot link also being connected to the support link, a control link connected between the front and rear pivot linkages for preventing collapse of the support link and pivot linkages on the base plate, and a handle operated linkage operatively connected to the front and rear pivot linkages of mechanisms for enabling an occupant of the chair to cause the support link and seat to move to the reclined position.

* * * * *